US005527128A

United States Patent [19]

Rope et al.

[11] Patent Number: 5,527,128

[45] Date of Patent: Jun. 18, 1996

[54] GROUND COVERING

[75] Inventors: Christopher C. Rope; Pamela A. Rope, both of Thetford; Ian M. D. Gaylor, Cambridge, all of United Kingdom

[73] Assignee: Portapath International Limited, London, United Kingdom

[21] Appl. No.: 450,908

[22] Filed: May 26, 1995

[51] Int. Cl.[6] ..... E01C 5/20

[52] U.S. Cl. ..... 404/35; 404/41; 52/588.1; 428/44

[58] Field of Search ..... 404/34, 35, 36, 404/41, 18; 52/177, 579, 581, 588.1, 580; 428/44, 45

[56] References Cited

U.S. PATENT DOCUMENTS

| | | | |
|---|---|---|---|
| 2,225,828 | 12/1940 | Godschall . | |
| 3,350,013 | 10/1967 | Bergquist . | |
| 3,425,624 | 2/1969 | Jacobs . | |
| 3,820,912 | 6/1974 | Hughes . | |
| 3,836,075 | 9/1974 | Botbol . | |
| 4,226,064 | 10/1980 | Kraayenhuf | 404/41 X |
| 4,497,858 | 2/1985 | Dupont et al. | 404/41 X |
| 4,681,482 | 7/1987 | Arciszewski et al. . | |
| 4,917,532 | 4/1990 | Haberhauer et al. | 404/35 |
| 4,964,751 | 10/1990 | Rope et al. . | |
| 4,973,505 | 11/1990 | Bielous | 52/177 X |
| 5,215,802 | 6/1993 | Kaars Sijpesteijn | 52/177 X |

FOREIGN PATENT DOCUMENTS

| | | |
|---|---|---|
| 2133158 | 1/1973 | Germany . |
| 3111005 | 9/1982 | Germany . |
| 208152 | 3/1940 | Switzerland . |
| 1107097 | 3/1968 | United Kingdom . |

*Primary Examiner*—Ramon S. Britts
*Assistant Examiner*—James A. Lisehora
*Attorney, Agent, or Firm*—Young & Thompson

[57] ABSTRACT

A ground covering is provided by linking together individual elements; the elements each comprise a first portion and a second portion linked by a hinge allowing the connected elements to be rolled up in the form of a carpet for easy storage and transport.

16 Claims, 2 Drawing Sheets

GROUND COVERING

BACKGROUND OF THE INVENTION

The present invention relates to ground covering and protection.

It is often desirable to temporarily cover ground in order to protect it; for example, when a concert is held in a sports stadium, it is desirable to protect the playing surface. Likewise, ground will need protecting by the provision of pathways, roadways and observation places during sporting events, for example golf matches, and the provision of floors in marquees and outdoor exhibitions.

It is known to provide duck boards and rigid wooden sections in order to provide such temporary ground cover. However, such devices are difficult to store and difficult and time consuming to lay, at least partly because they are large, heavy and cumbersome. Furthermore, they are not readily transportable and do not readily adapt to being laid on uneven ground.

Furthermore, conventional duck boards contain slats; narrow heels can be trapped in between the slats, causing aggravation to the wearer (the so called "stiletto trap"). U.S. Pat. No. 4,969,751 describes a duck board that can be rolled up and so is readily transportable and storable but is still liable to provide a stiletto trap; also, it would be difficult and time-consuming to lay in large areas, such as is necessary to cover a football pitch.

SUMMARY OF THE INVENTION

It is an object of the present invention to overcome the above disadvantages.

It is a further objection of the present invention to provide a readily transportable and storable temporary ground cover that can be quickly and easily laid and, at least in one embodiment, does not give rise to a stiletto trap.

The present invention provides discrete elements that can be linked together to form ground covering for protection of the ground on which it is laid and for providing a useable surface for example in the form of a roadway, walkway or floor; each element is integral and comprises:

a first portion comprising a base for engaging the ground and an upper face for forming part of the said useable surface; a second portion lying adjacent to the first portion; hinge means connecting the first portion and the second portion for permitting the said first and second portions to pivot with respect to each other about an axis extending substantially parallel to the said upper face of the first portion; and first and second linking means provided respectively on the said first and second portions, said first linking means for cooperating with a second linking means of an adjacent identical ground covering element to join such elements together and said second linking means for cooperating with a first linking means of a further adjacent identical ground covering element to join such elements together, whereby a number of such elements can be joined together to form said ground covering.

The hinge in the integral element allows a length of joined-together elements to be rolled up in a manner similar to a carpet for easy storage and transport. Furthermore, such a length can readily be unrolled to quickly and simply cover a large area when the ground cover protection is required. Also the hinge allows the ground cover to adapt to the contours of the ground on which it is laid, thereby minimising the cover "see-sawing" on a raised part of the ground.

The present invention also provides ground covering comprising a number of the said elements that have been linked together.

BRIEF DESCRIPTION OF THE DRAWINGS

An embodiment of the ground cover element of the present invention will now be described by way of example only with reference to the accompanying drawings in which.

DESCRIPTION OF THE PREFERRED EMBODIMENT

Figure 1:
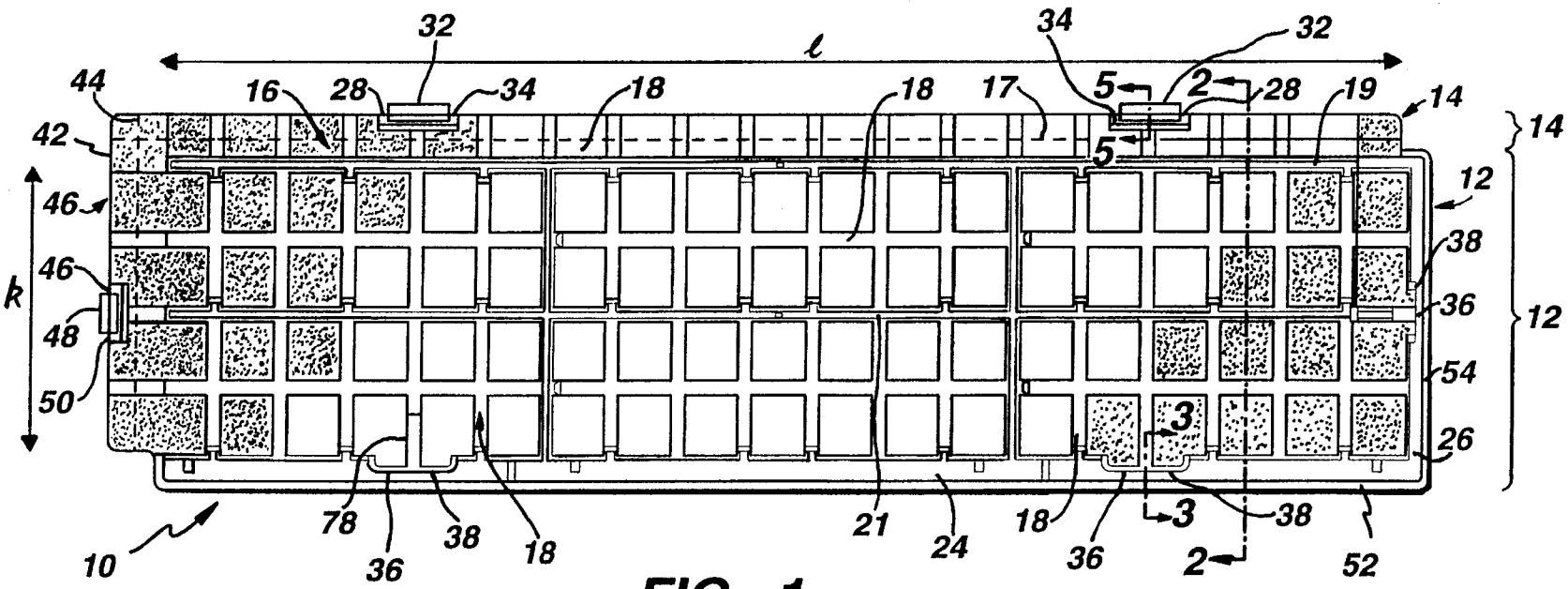
FIG. 1 is a plan view of a ground covering element according to the present invention.
Figure 2:
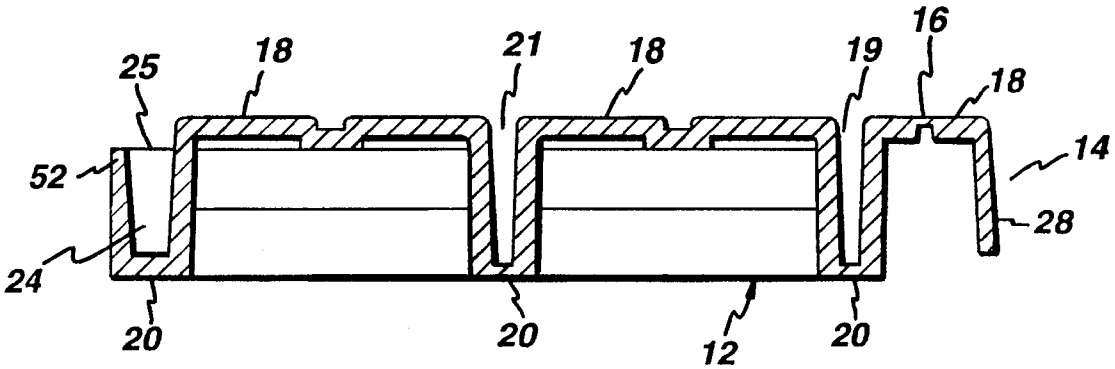
FIG. 2 is a sectional view of the element of FIG. 1 along line A—A.

Referring initially to FIGS. 1 and 2, there is shown an integral rectangular ground cover element 10 formed from a single moulding of polypropylene and comprising a first portion 12 and a second portion 14 connected by a flexible hinge 16 (see FIG. 2) that allows the first and second portions 12, 14 to pivot with respect to each other about axis 17 (see FIG. 1). The hinge 16 is formed by a thinned out section of the moulding. Each of portions 12 and 14 include a top surface 18 that forms part of a pathway, roadway or floor. Each element includes two intermediate channels 19, 21 and an edge channel 24, each extending longitudinally along the element. The bases 20 of these channels (see FIG. 2) rest on the ground that is being protected and so form the base of the element.

Figure 3:
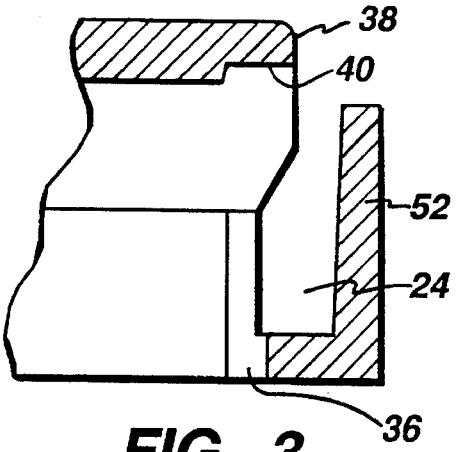
FIG. 3 is a sectional view of the element of FIG. 1 along line B—B.
Figure 4:
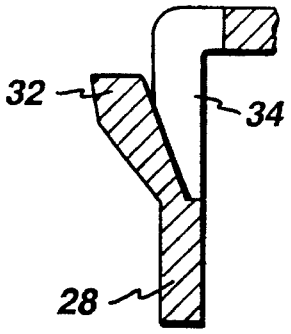
FIG. 4 is a sectional view of the element of FIG. 1 along line C—C.
Figure 5:
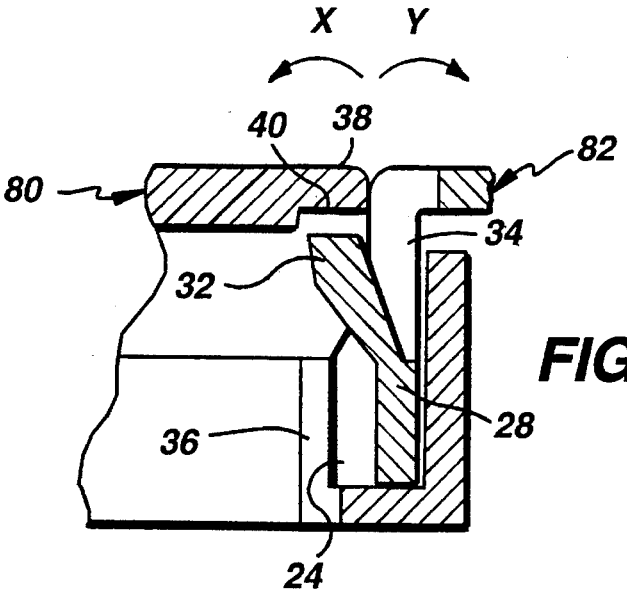
FIG. 5 is a sectional view showing how the parts shown on FIGS. 3 and 4 can be linked together to join adjacent elements together.
Figure 6:
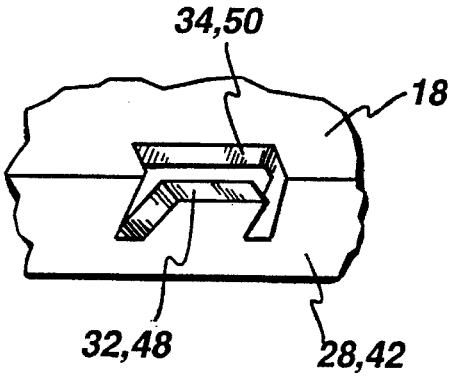
FIG. 6 is a perspective view of a tab of the element of FIG. 1.

The second portion 14 includes a downwardly projecting rib 28 (see FIG. 2) extending longitudinally along most of the side of the element opposed to channel 24; the length "l" of the rib is shown in FIG. 1. In order to join two elements of the ground covering together, the rib 28 of one element is inserted into the edge channel 24 of the second element through the open top 25 of the channel and pressed downwards. Cantilever tabs 32 (shown in perspective in FIG. 6) are formed in cutouts 34 at two locations along the rib 28. At corresponding locations in the channel 24, cutouts 36 are also provided. Above each cutout 36 is a projection 38 (see FIG. 3). When the rib 28 is inserted into channel 24, the projection 38 pushes the cantilever tab 32 backwards into the cutout 34; however, as the rib 32 continues to be inserted into the channel 24, the top of the cantilever tab 32 is eventually below the level of the projection 38 and, as a result of its resilience, springs out and engages the underside 40 of the projection 38, thereby holding the rib 28 in the channel 24. This arrangement is shown in FIG. 5 of the accompanying drawings.

A further edge channel 26 is located along one of the shorter sides of the rectangular element shown in FIG. 1 and a cutout 36, including a projection 38, is located part of the way along its length. Along the shorter side of the element opposed to channel 26, a further portion 42 is provided that is connected to the first portion 12 by a hinge 44 that is identical to the hinge 16. The portion 42 also includes a downwardly-extending rib 46 that is similar to rib 28 and extends along distance "k" shown in FIG. 1. Along rib 46, there is provided a cantilever tab 48 in a cutout 50 of a design corresponding to tab 32 and cutout 34. Adjacent elements can be joined side-by-side in the manner described above, that is to say by inserting rib 46 of one element into the channel 26 of an adjacent element so that the tab 48 of the first element engages in the cut-out 36 of the second element to retain the rib 46 in the channel 26.

A large extent of ground covering can be formed by joining a large number of elements together in the manner described above, i.e. by engaging the ribs 28 and 46 of one element in the channels 24 and 26 of other elements. Because the resulting ground cover can flex about hinges 16 and 44, the ground cover can follow the contour of the underlying ground.

Figure 7:
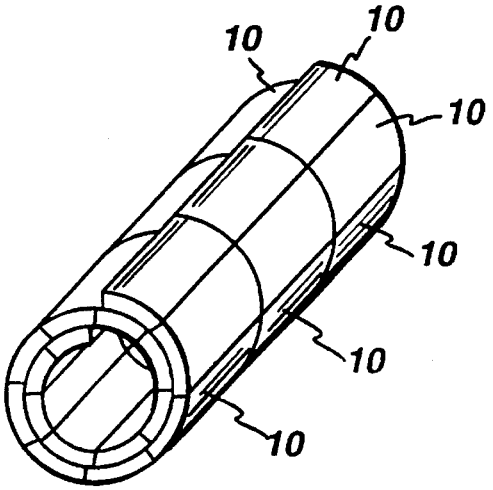
FIG. 7 is a view of forty eight elements joined together and rolled up.

As stated, each element can pivot, relative to its adjacent element, about hinge 16, and so the ground covering made up of a number of elements can simply be rolled up in a manner similar to a carpet, as shown in FIG. 7, which shows a ground covering consisting of forty eight elements joined together in an array of sixteen elements by three elements. Usually, the covering will be transported and stored in the form of a roll and when it is desired to use the floor covering, it is simply unrolled over the ground to be protected. Alternatively, the covering can be stored and transported in the form of a flat panel made up of a number of elements joined together. Such panels may be joined in situ.

Each element is made of a single moulding of polypropylene. It may be square or rectangular.

In order to break up an area of ground covering into individual elements, it is possible to press the cantilever tabs 32 and 48 into their corresponding cut-outs 34, 50 and so allow the ribs 28 and 46 to be removed from corresponding channels 24 and 26. As an alternative, the outer wall 52 of channel 24 and the outer wall 54 of channel 26 are flexible and so by forcing element 80 in the direction of arrow "X" in FIG. 5 and panel 82 in the direction of arrow "Y" shown in FIG. 5, it is possible pivot the two elements with respect to one another and bring the cantilever tabs 32, 48 clear of projection 38 and, when this is done, the ribs 28 and 46 can merely be pulled out from corresponding channels 24, 26. This action is assisted by the resilience of tabs 32, 48 and of the projections 38 (the projections 38 can be provided with extra "give" by including slots 78 in the upper surface 18 above the projections (see FIG. 1)).

As can be seen from the accompanying drawings, the only channels formed in the top surface 18 of the covering, when the elements are assembled, are channels 19 and 21 (channels 24 and 26 being closed off by the insertion of ribs 28, 46). The width of channels 19 and 21 are sufficiently narrow not to form stiletto traps. However, it is possible to "fill in" channels 19 and 20 so as to form solid ribs.

The ground covering according to the present invention may be used to cover sports and games surfaces of arenas for special events, for example concerts or to form the flooring of a marquee or to provide a roadway or pathway or to provide an outdoor surface or even to provide a car parking area; in all instances, the ground covering of the present invention protects the underlying ground from being damaged by pedestrians or vehicles.

If intended to cover a certain known surface, e.g. the pitch of a sports stadium, rolls of already connected elements of the exact length and width of the pitch can be stored and simply rolled out when required.

Often, it will be impractical to store a roll of elements for covering the whole of a surface and then the elements will be stored in several rolls that can be joined together when it is desired to cover the surface. An area of ground will be covered by unrolling a first roll; then a second roll will be unrolled and, during the unrolling process, the edge elements of the two rolls can be joined; this is achieved in the manner described above by inserting the ribs 46 of the edge elements of the second roll into the channels 26 of the edge elements of the first roll all the way along the adjacent edges of the two rolls so as to form, in the case of two rolls of the type shown in FIG. 7, an array of sixteen elements by six elements. Subsequent rolls can be joined in the same way to cover the desired area.

The elements are so designed, however, that when the first roll of ground covering has been unrolled, the second roll can be connected thereto simply by pressing the ribs 46 of the first few elements of the second roll into the channels 26 of the adjacent elements of the first roll and unrolling the second roll; the rib 46 of each element of the second roll comes into engagement with the channel 26 of the adjacent element of the first roll automatically without having to locate it individually by hand. This occurs because, as the second roll is unrolled, the engagement of the rib 46 of one of the elements of the second roll in the channel 26 of the adjacent element of the first roll guides the rib 46 of the succeeding element of the second roll into the corresponding channel 26 of the succeeding element of the first roll; in this way, rolls of elements can be joined in the manner of a zipper. Further, the momentum of the unrolling process can used to provide the energy required to completely seat the ribs 46 of the second roll into the channels 26 of the first roll and in this way the ground covering can be very rapidly laid. If necessary, the ribs of the second roll can be pressed home into the channels of the first roll when this is not completely achieved by the momentum of the unrolling process.

If a roll is not long enough to extend along the whole length of the area being covered, two or more rolls can be joined end-to-end until the desired length is achieved.

We claim:

1. An element for linking together with identical elements to form a ground covering for protecting ground on which it is laid and for providing a useable surface such as a roadway, walkway or floor, which element is integral and comprises:

a first portion comprising a base for engaging the ground and an upper surface for forming part of the said useable surface;

a second portion lying adjacent to the first portion;

hinge means connecting the first portion and the second portion for permitting the said first and second portions to pivot with respect to each other about an axis extending substantially parallel to the said upper surface of the first portion; and first and second linking means provided respectively on the said first and second portions, said first linking means for cooperating with a second linking means of an adjacent identical ground covering element to join such elements together and said second linking means for cooperating with a first linking means of a further adjacent identical ground covering element to join such elements together, whereby a number of such elements can be joined together to form the said ground covering.

2. A ground covering element according to claim 1, wherein said second portion includes an upper surface for forming part of the said useable surface.

3. A ground covering element according to claim 1, wherein the axis of the said hinge means lies within the plane of the said upper surface of the first portion.

4. A ground covering element as claimed in claim 3 wherein said hinge means extends along an edge of the upper surface of the first portion.

5. A ground covering element as claimed in claim 1, wherein the first and second linking means comprises a male member and a female member that can be engaged together thereby linking adjacent elements together.

6. A ground covering element as claimed in claim 5, which includes means for retaining the male and female members in engagement.

7. A ground covering element as claimed in claim 6, wherein the retaining means comprises a resilient tab provided on one of the said members and a corresponding recess provided in the other of the said members, said tab and recess being such that the tab engages in the recess to prevent the male and female members being disengaged.

8. A ground engaging element as claimed in claim 7, wherein the female element comprises a flexible wall such that two linked elements can be disengaged by pivoting the elements to flex the said wall and release the tab from the recess thereby allowing the male and female members to be separated.

9. A ground covering element as claimed in claim 1, wherein third and fourth linking means are provided along opposed sides of the element, said third and fourth linking means being provided along different sides of the element to the first and second linking means, said third linking means for cooperating with a fourth linking means of an identical adjacent ground covering element to join the elements together and said fourth linking means for cooperating with a third linking means of an identical adjacent ground covering element to join the elements together, whereby adjacent ground forming elements can be linked side by side.

10. A ground covering element as claimed in claim 9, wherein the third and fourth linking means comprises a male member and a female member that can be engaged together thereby linking adjacent elements together.

11. A ground covering element as claimed in claim 10, which includes means for retaining the male and female members in engagement.

12. A ground covering element as claimed in claim 12, wherein the retaining means comprises a resilient tab provided on one of the said members and a corresponding recess provided in the other of the said members, said tab and recess being such that the tab engages in the recess to prevent the male and female members being disengaged.

13. A ground engaging element as claimed in claim 12, wherein the female element comprises a flexible wall such that two linked elements can be disengaged by pivoting the elements to flex the said wall and release the tab from the recess thereby allowing the male and female members to be separated.

14. A ground covering element as claimed in claim 9, wherein the third linking means is connected to the first portion by a hinge means.

15. Ground covering comprising a plurality of elements as claimed in claim 1, said elements being joined to provide a roadway, walkway or floor by engaging the first linking means of each element with the second linking means of an adjacent element, whereby the said roadway, walkway or floor is built up.

16. Ground covering as claimed in claim 15, in the form of a roll.

* * * * *